US006126215A

United States Patent [19]

Jahns

[11] Patent Number: 6,126,215

[45] Date of Patent: Oct. 3, 2000

[54] DEVICE FOR HANDLING AND BAGGING ANIMAL REFUSE OR OTHER OBJECTS

[76] Inventor: Henner Jahns, 528 E. 5th St., Apt. 1A, New York, N.Y. 10009

[21] Appl. No.: 09/252,944

[22] Filed: Feb. 18, 1999

[51] Int. Cl.[7] ..... A01K 29/00; E01H 1/12

[52] U.S. Cl. ..... 294/1.3

[58] Field of Search ..... 294/1.1, 1.3, 25, 294/55; 15/257.1, 257.5–257.9; 248/95, 99, 101; 383/6, 7, 33, 34

[56] References Cited

U.S. PATENT DOCUMENTS

| | | | |
|---|---|---|---|
| D. 262,943 | 2/1982 | Schadler | D9/337 |
| D. 386,840 | 11/1997 | Sturm | D30/162 |
| 3,286,826 | 11/1966 | Stoll | 294/1.3 |
| 3,676,887 | 7/1972 | Klein | 15/104.8 |
| 3,739,418 | 6/1973 | Yonaites et al. | 15/104.8 |
| 3,806,984 | 4/1974 | Hilsabeck | 294/1.3 |
| 3,978,540 | 9/1976 | Peck et al. | 15/104.8 |
| 4,103,952 | 8/1978 | Thompson | 294/1.3 |
| 4,138,153 | 2/1979 | Brown | 294/1.3 |
| 4,230,354 | 10/1980 | Claras | 294/1.3 |
| 4,341,410 | 7/1982 | Summach | 294/1.3 |
| 4,458,932 | 7/1984 | Resch | 294/1.3 |
| 4,530,533 | 7/1985 | Dieter | 294/1.1 |

FOREIGN PATENT DOCUMENTS

| | | | |
|---|---|---|---|
| 3343729 | 6/1984 | Germany | 294/1.3 |
| 1150742 | 4/1969 | United Kingdom | 294/1.3 |
| 9409212 | 4/1994 | WIPO | 294/1.3 |

*Primary Examiner*—Johnny D. Cherry
*Attorney, Agent, or Firm*—LaMorte & Associates

[57] ABSTRACT

A low cost scoop device for scooping animal waste or other loose material. The scoop contains a disposable bag having an open end. The bag is held open by a collapsible paperboard frame of a unique configuration. The paperboard frame has a bottom element, a first side element, a second side element and a handle structure. When the paperboard frame is in a deployed configuration, the bottom edge, first side edge and second side edge form a triangular frame with a triangular central opening. The triangular frame holds open the open end of the bag. When the paperboard frame is in a folded configuration, the bottom edge, first side edge and the second side edge lay flat atop one another in a compact folded package.

13 Claims, 8 Drawing Sheets

DEVICE FOR HANDLING AND BAGGING ANIMAL REFUSE OR OTHER OBJECTS

BACKGROUND OF THE INVENTION

1. Field of the Invention

In general, the present invention relates to portable scoopers that enable people to scoop up animal refuse or other material in a sanitary fashion. More specifically, the present invention relates to scoops made from the selective folding of a paperboard blank.

2. Description of the Prior Art

Many different cities and other municipalities have ordinances that require pet owners to clean up after their pets if their pets defecate on public property. Due to such ordinances, many pet owners carry some sort of disposal material that can help the pet owner handle and dispose of the animal waste in a sanitary manner. The disposal material may just be a piece of newspaper, a plastic bag or some other generic material that can be used to grasp and wrap the waste. Such generic approaches are inexpensive but have limitations in their effectiveness, ease of use, and ability to maintain a sanitary condition.

Recognizing the limitations of generic approaches, pet owners have developed many different types of dedicated devices that help them handle and dispose of waste. One type of device is the reusable scoop. Such devices are economical to use. However, these devices must be washed after they are used. In order to eliminate the unpleasant task of washing animal waste from a reusable scoop, pet owners have developed one-time-use disposable scoops. Such scoops are used to scoop up animal waste and are then thrown away with the animal waste. Dozens of disposable scoops may be used by a pet owner in a single week. Accordingly, in order for such disposable scoops to be cost effective, they must be made to be very inexpensive.

A popular type of inexpensive disposable scoop is the type where the mouth of a disposable plastic bag is held open by a folded paperboard frame. In order for such disposable scoops to be effective, the folded paperboard frame must provide the disposable bag with a wide, flat base to receive the waste and a handle to hold the device in a sanitary fashion. Examples of such disposable scoops are shown in U.S. Pat. No. 4,138,153 to Brown, entitled Sanitary Self-Contained Fecal Waste Container and U.S. Pat. No. 4,230,354 to Claras, entitled Pick Up And Disposal Kit For Pet Ordure. Some prior art disposable scoops have paperboard frames with square configurations or circular configurations. Such prior art disposable scoops lack lateral integrity. Accordingly, such prior art scoops have a tendency to collapse when in use, thereby failing to properly perform its designed function.

Another problem associated with some prior art disposable scoops, such as those cited above, is that the paperboard frame folds into a complex configuration. Accordingly, the disposable bag that attaches to the paperboard frame must be either manufactured or folded in a complex configuration in order to properly conform to the paperboard frame. This adds to the cost and complexity of manufacturing the disposable scoops.

Prior art scoops that support commonly formed bags or commonly folded bags are exemplified by U.S. Pat. No. 4,103,952 to Thompson, entitled Combination Bag And Scoop. Such devices have a paperboard frame that are essentially circular, thereby being easily attached to the open end of a standard shaped bag. A disadvantage of such designs, however, is that circular frame designs generally do not readily provide flat bottom surfaces and lack lateral stability. Additionally, circular paperboard frames, such as that in the Thompson patent, have handles that expose fingers to the interior of the bag and the waste that bag holds. As a result, such designs tend not to be as sanitary as complex paperboard frames that provide external handles.

A need therefore exists for an inexpensive disposable scoop that uses a paperboard frame with a bag of a simple construction, yet embodies a flat bottom for ease of use and a fully sanitary handle structure. A need also exists for a disposable scoop that uses a paperboard frame with a flat bottom yet provides improved lateral rigidity. These needs are met by the present invention device as described and claimed below.

SUMMARY OF THE INVENTION

The present invention is a low cost scoop device for scooping animal waste or other loose material. The scoop contains a disposable bag having an open end. The bag is held open by a collapsible paperboard frame of a unique configuration. The paperboard frame has a bottom element, a first side element, a second side element and a handle structure. When the paperboard frame is in a deployed configuration, the bottom edge, first side edge and second side edge form a triangular frame with a triangular central opening. The triangular frame holds open the open end of the bag and provides lateral stability. When the paperboard frame is in a folded configuration, the bottom edge, first side edge and the second side edge lay flay atop one another in a compact folded package.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention device can be used to scoop most any type of loose material, such as jelly beans, peanuts, nails or the like, the present invention is especially well suited for scooping animal waste from the ground.

Accordingly, by way of example, the shown embodiment will be referenced in an application of removing animal waste from the ground.

Figure 1:
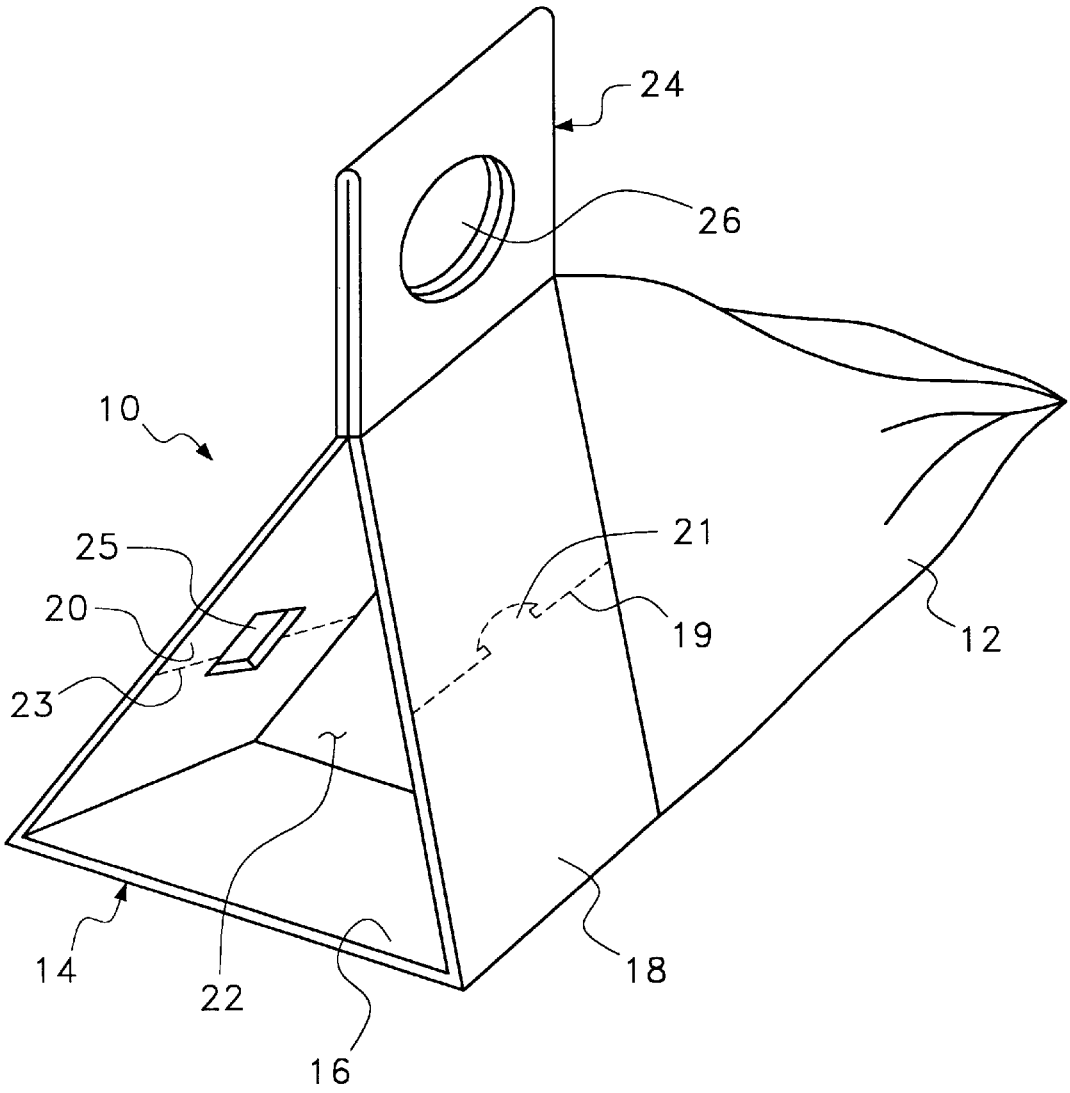
FIG. 1 is a perspective view of a scoop device while in a deployed configuration, in accordance with the present invention.

Referring to FIG. 1, an exemplary embodiment of a scoop device 10 is shown in accordance with the present invention. The scoop device 10 is shown in its fully deployed configuration. The details of how the scoop device 10 transforms from a folded configuration to the shown deployed configuration will be later described.

The scoop device 10 contains a common bag 12 that has a closed end and an open end. The open end of the bag 12 can have a circular or oval shape, as is tradition for many common bags. The bag 12 itself can be fabricated from plastic, paper or wax coated paper.

The open end of the bag 12 is affixed to a paperboard frame 14. The paperboard frame 14 holds the open end of the bag 12 in an open orientation so that material can easily enter the bag 12 through the center of the paperboard frame 14. In the shown embodiment, the paperboard frame 14 is triangular in shape, having a flat bottom element 16 and two sloping side elements 18, 20. The sloping side elements 18, 20 converge at an apex. The bottom element 16 and the two side elements 18, 20 define a central open area 22 that leads into the mouth of the bag 12. The triangular shape of the paperboard frame 14 provides the scoop device 10 with lateral stability that prevents the scoop device 10 from easily collapsing when used. A folding line 19 is disposed in the center of the first side element 18 of the paperboard frame 14. A cut-out of a locking pawl 21 is present in the center of the folding line. Similarly, a folding line 23 is disposed near the middle of the second side element 20. An aperture 25 is present near the center of the folding line. The purpose of the aperture 25, the locking pawl 21 and the two folding lines 19, 23 will later be explained.

A handle structure 24 extends upwardly from the apex of the paperboard frame 14. The handle structure 24 has an aperture 26 extending through its structure. The aperture 26 is sized to accept a person's fingers as a person grasps the handle structure 24. When a person is grasping the handle structure 24, that person's hands and fingers are isolated from the central open area 22 of the paperboard frame 14. Accordingly, animal waste cannot contaminate the hands of the user as the animal waste passes through the paperboard frame 14.

The bottom element 16 of the paperboard frame 14 lays in the horizontal. As a result, the bottom element 16 of the paperboard frame 14 would lay flush against the ground when the paperboard frame 14 is placed on the ground. The wide base opening of the paperboard frame 14 facilitates the easy scooping of animal waste from the ground. Alternatively, waste could also be readily pushed through the paperboard frame 14 with a stick, paperboard paddle or like instrument.

Figure 2:
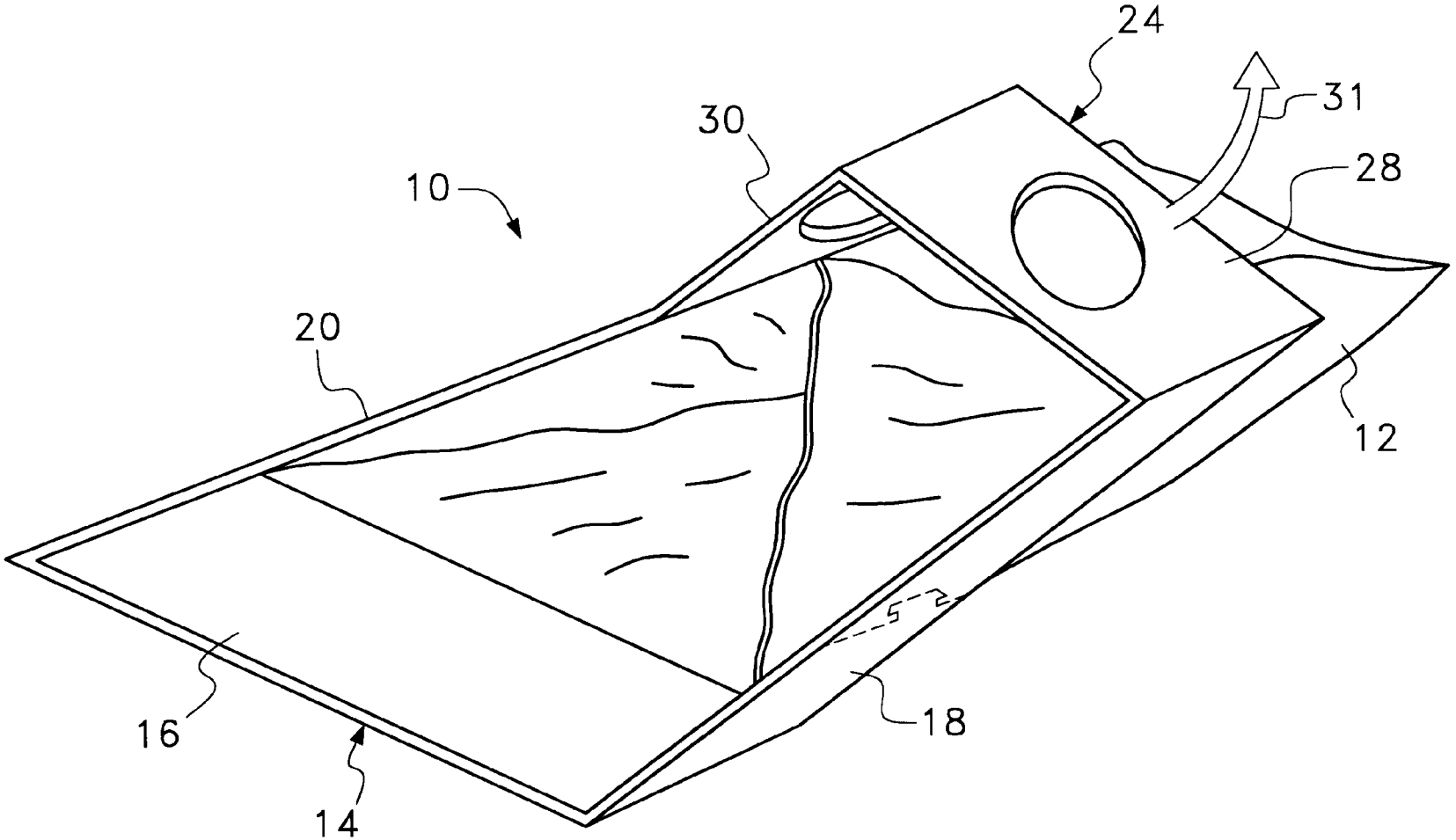
FIG. 2 is a perspective view of the embodiment of FIG. 1, while in transition between a deployed configuration and a folded configuration.

Referring to FIG. 2, it can be seen that the paperboard frame has a continuous construction. The handle structure 24 is made of a first handle element 28 that is attached to an identical second handle element 30. When the two handle elements 28, 30 abut against each other, the handle structure 24 is formed. The bottom edge of the first handle element 28 is connected to the top edge of the first side element 18. Similarly, the bottom edge of the second handle element 30 is connected to the top edge of the second side element 20. The bottom edge of both the first side element 18 and the second side element 20 connects to opposite ends of the bottom element 16 to complete the continuous construction.

In FIG. 2, the first handle element 28 is pulled away from the second handle element 30 in the direction of arrow 31. From this orientation, it can be seen that the open edge of the bag 12 is not attached to the first side element 18 of the paperboard frame 14. Rather, only the second side element 20 and the bottom element 16 are adhered to the open edge of the bag 12. By not adhering the bag 12 to the first side element 18 of the paperboard frame 14, the paperboard frame 14 is free to move between its folded configuration and its deployed configuration previously shown in FIG. 1.

Figure 3:
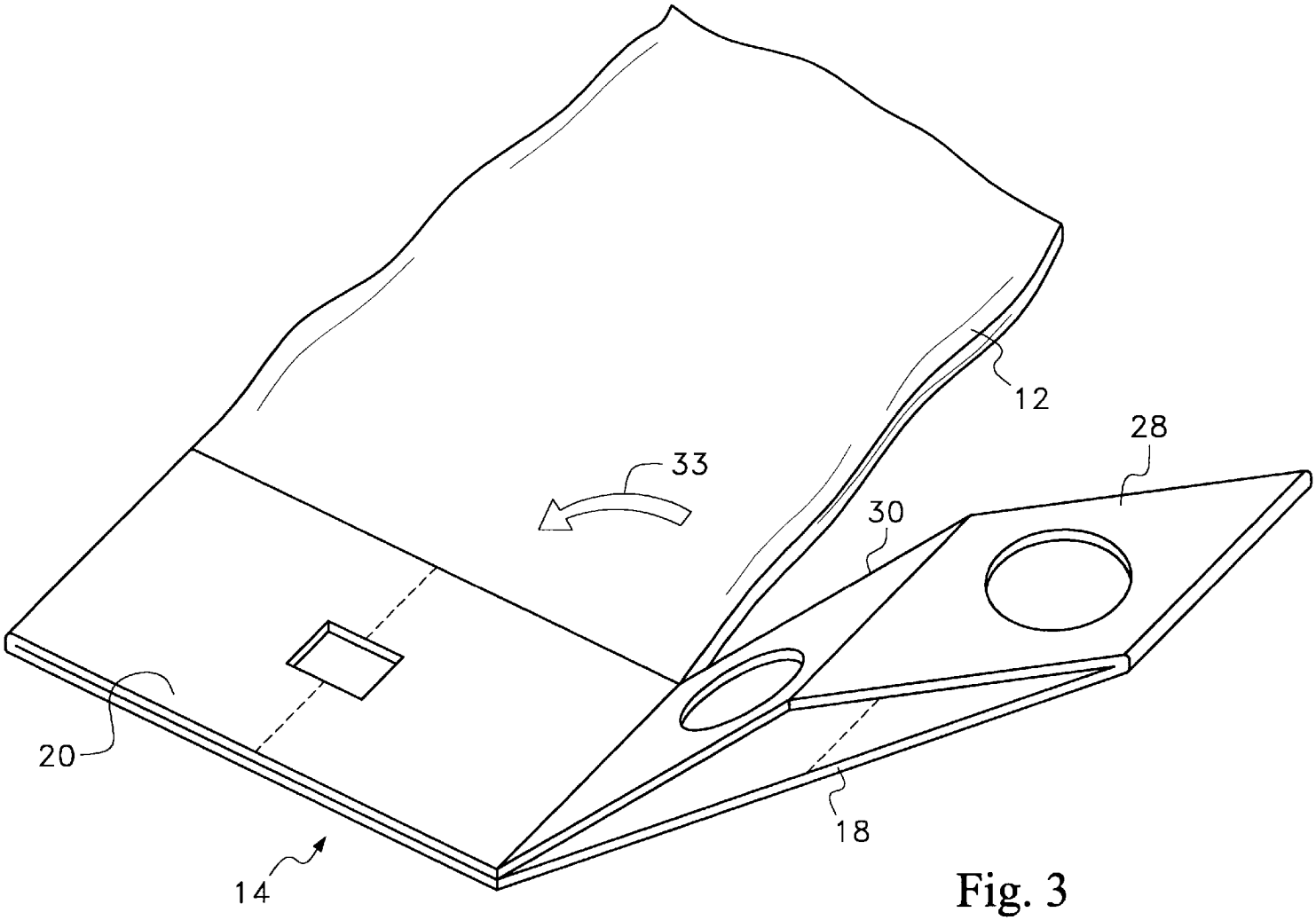
FIG. 3 is a perspective view of the embodiment of FIG. 1, while in transition between a deployed configuration and a folded configuration.

In FIG. 2, it can be seen that as the first handle element is moved in the direction of arrow 31, the angle between the first handle element 28 and the second handle element 30 increases. Similarly, the angle between the first side element 18 and the bottom element 16 also increases. Referring to FIG. 3, it can be seen that to fold the paperboard frame 14 into its folded configuration, the second side element 20 is folded down onto the bottom element 16. Since both the second side element 20 and the bottom element 16 are connected to the bag 12, the folding of the second side element 20 onto the bottom element 16 causes the bag 12 to close. The folding of the second side element 20 onto the bottom element 16 also causes the angle between the two handle elements 28, 30 to approach 180°.

Figure 4:
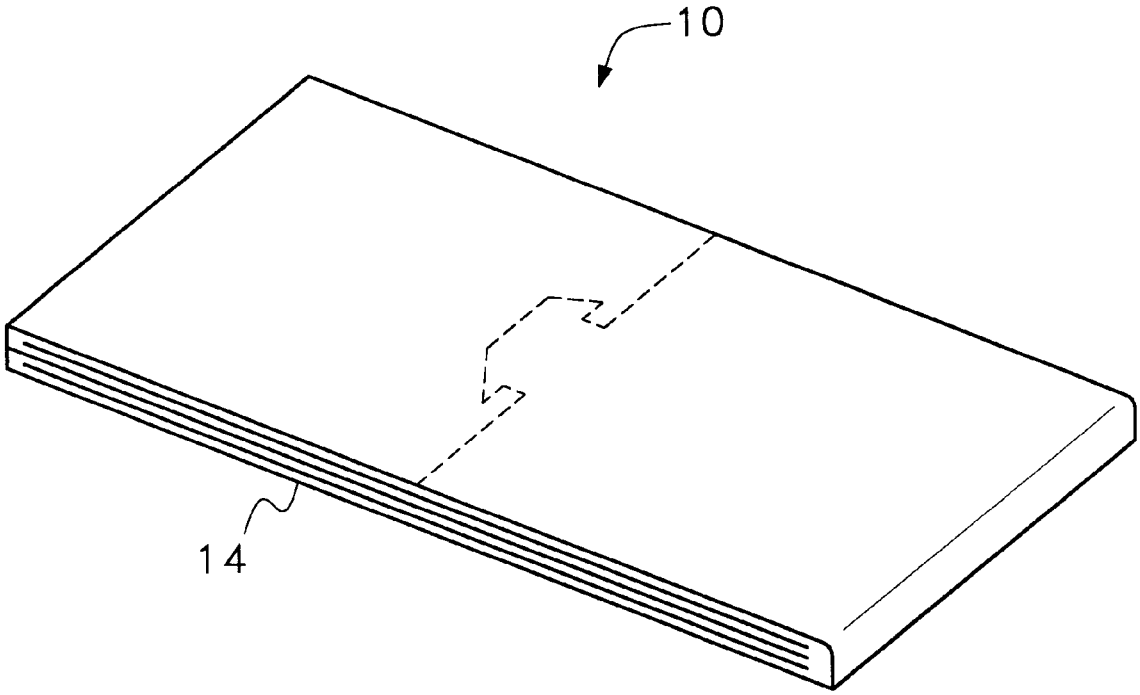
FIG. 4 is a perspective view of the embodiment of FIG. 1 in a folded configuration.

When the two handle elements 28, 30 assume a linear orientation, the handle elements 28, 30 lay against the first side element 18. The abutting first side element 18 and handle elements 28, 30 are then folded over the second side element 20 and the bottom element 16 in the direction of arrow 33. The combined lengths of the handle elements 28, 30 are generally the same as the length of the second side element 20. Similarly, the length of the first side element 18 has the same general length as does the bottom element 16. Accordingly, when the various elements are free to lay across one another, the overall paperboard frame forms the flat, folded orientation shown in FIG. 4.

Figure 5:
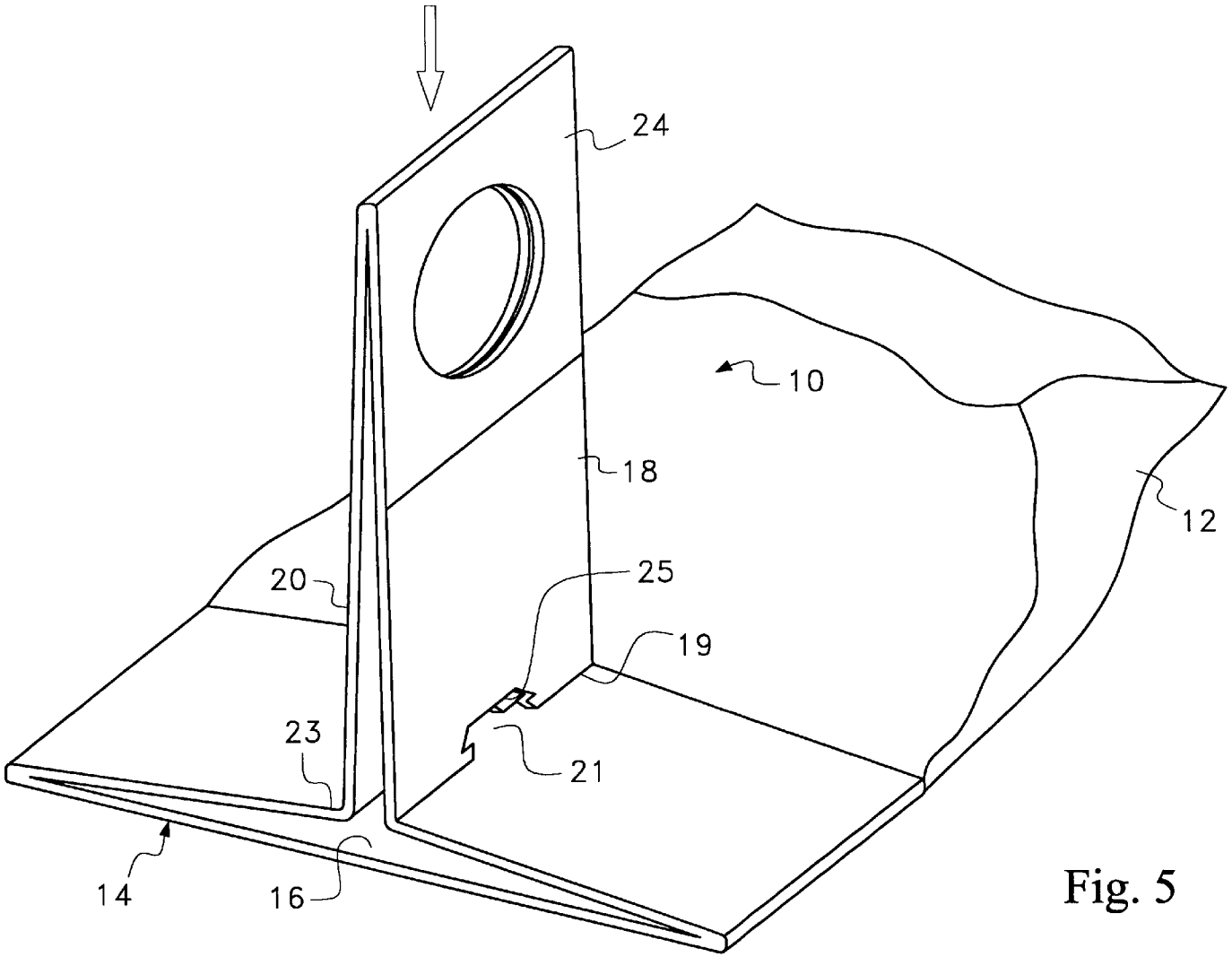
FIG. 5 is a perspective view of the embodiment of FIG. 1 shown in a deployed but closed configuration.

The scoop device 10 is used when the scoop device 10 is in the unfolded orientation represented in FIG. 2. Once the scoop device 10 is used to pick up refuse, the scoop device 10 can be sealed in a sanitary manner. Referring to FIG. 5, it can be seen that to seal the scoop device 10, a person pushes downwardly on the handle structure 24 of the scoop device 10. By pushing on the handle structure 24, the side elements 18, 20 buckle and fold inwardly along their respective fold lines 19, 23. As the side elements 18, 20 buckle, the lower halves of the side elements 18, 20 fold against the bottom element 16 of the paperboard frame 14. As the lower halves of the side elements 18, 20 fold against the bottom element 16 of the paperboard frame 14, the locking pawl 21 on the first side element 18 engages the aperture 25 in the second side element 20. As the locking pawl 21 engages the aperture 25, the first side element 18 and the second side element 20 become locked together, thereby closing the paperboard frame 14 and the disposable bag 12 filled with the refuse.

Figure 6:
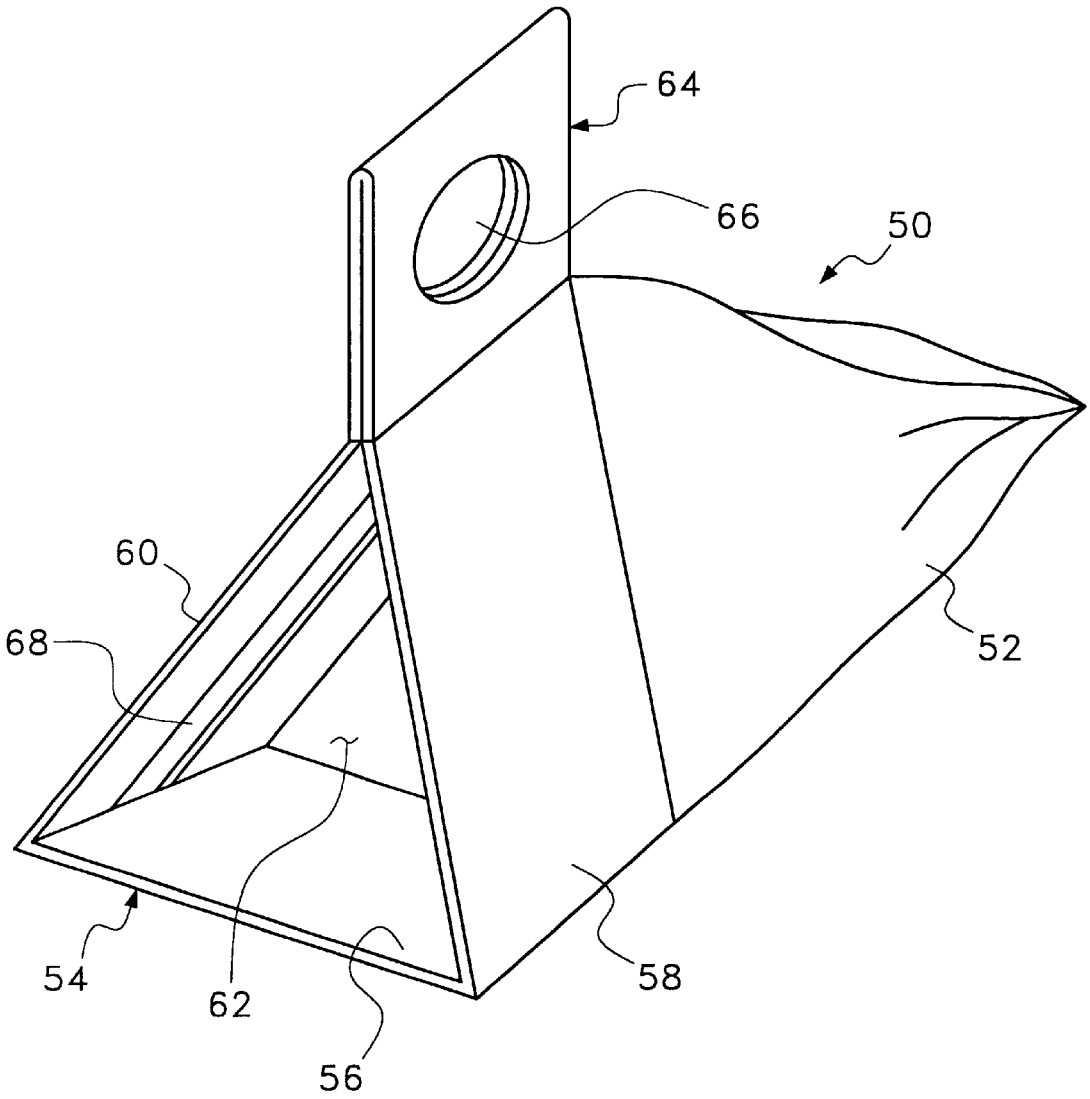
FIG. 6 is a perspective view of a second embodiment of a scoop device in accordance with the present invention.

Referring now to FIG. 6, an alternate embodiment of a scoop device 50 is shown in accordance with the present invention. Like the previously described embodiment, the shown embodiment includes a common disposable bag 52 that is held open by a paperboard frame 54. In the shown embodiment, the paperboard frame 54 is again triangular in shape, having a flat bottom element 56 and two sloping side elements 58, 60. The sloping side elements 58, 60 converge at an apex. The bottom element 56 and the two side elements 58, 60 define a central open area 62 that leads into the mouth of the bag 52.

A handle structure 64 extends upwardly from the apex of the paperboard frame 54. The handle structure 64 has an aperture 66 extending through its structure. The aperture 66 is sized to accept a person's fingers as a person grasps the handle structure 64. When a person is grasping the handle structure 64, that person's hands and fingers are isolated from the central open area 62 of the paperboard frame 54. Accordingly, animal waste cannot contaminate the hands of the user as the animal waste passes through the paperboard frame 54.

The bottom element 56 of the paperboard frame 54 lays in the horizontal. As a result, the bottom element 56 of the paperboard frame would lay flush against the ground when the paperboard frame 54 is placed on the ground. The wide base opening of the paperboard frame 54 facilitates the easy scooping of animal waste from the ground.

A slot 68 extends through the middle of the second side element 60 of the paperboard frame 54. Referring to FIG. 6, it can be seen that the paperboard frame 54 has a continuous construction. The handle structure 64 is made of a first handle element 70 that is attached to an identical second handle element 72. When the two handle elements 70, 72 abut against each other, the handle structure 64 is formed. The bottom edge of the first handle element 70 is connected to the top edge of the second side element 60. The bottom edge of the second handle element 72 is connected to the top edge of the first side element 58 with a narrow connection that extends through the slot 68 in the second side element 60. The bottom edge of both the first side element 58 and the second side element 60 connects to opposite ends of the bottom element 56 to complete the continuous construction.

Figure 7:
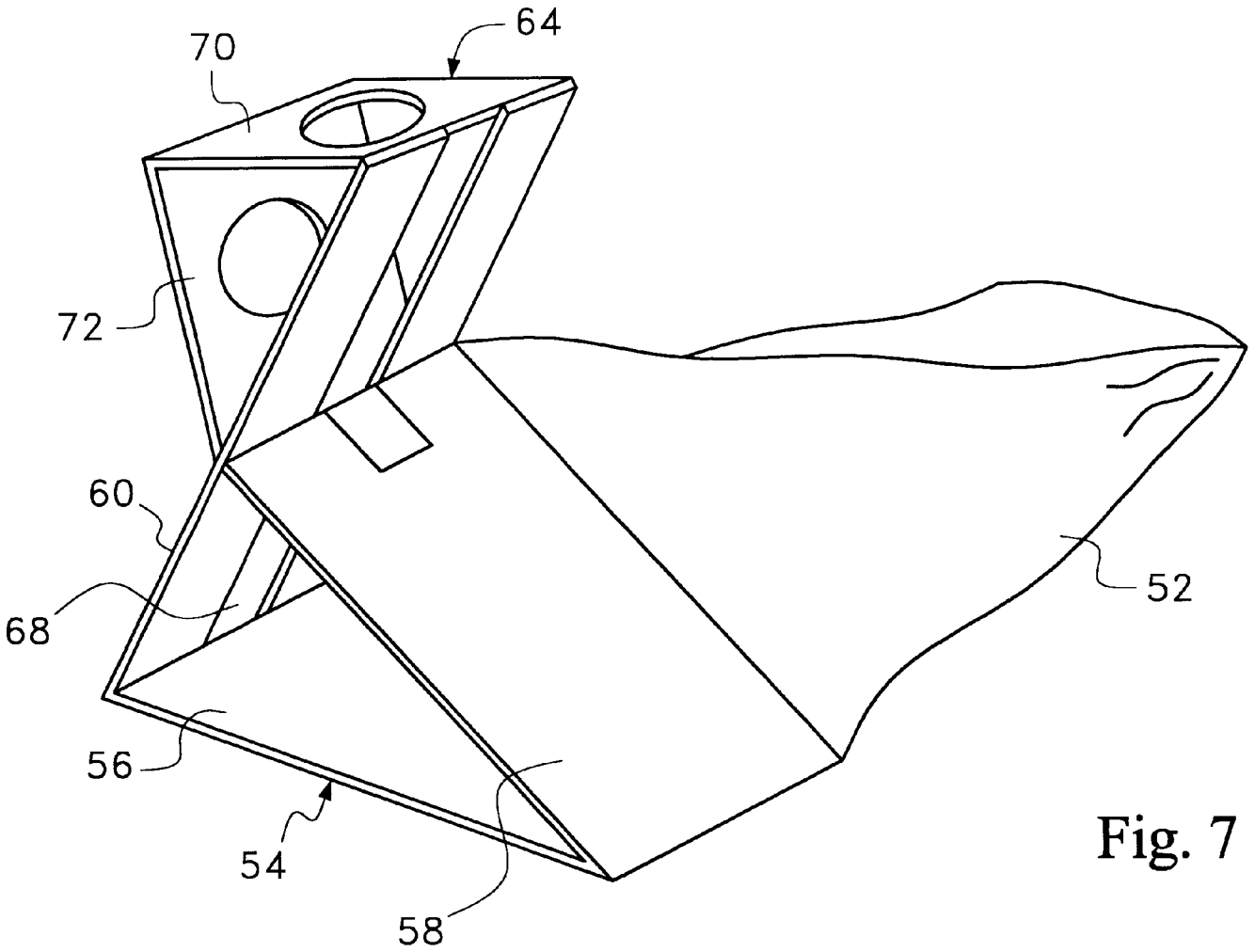
FIG. 7 is a perspective view of the embodiment of FIG. 6, while in transition between a deployed configuration and a folded configuration.

In FIG. 7, the second handle element 72 is pulled away from the first handle element 70. Although not shown, it will be understood that the open edge of the bag 52 is not attached to the second side element 60 of the paperboard frame 54. Rather, only the first side element 58 and the bottom element 54 are adhered to the open edge of the disposable bag 52. By not adhering the bag 52 to the second side element 60 of the paperboard frame 54, the paperboard frame 54 is free to move between its folded configuration and its deployed configuration previously shown in FIG. 6.

In FIG. 7, it can be seen that as the second handle element 72 is moved downwardly, the angle between the first handle element 70 and the second handle element 72 increases. Similarly, the angle between the first side element 58 and the base element 56 also decreases. To fold the paperboard frame 54 into its folded configuration, the first side element 58 is folded down onto the bottom element 56. Since both the first side element 58 and the bottom element 56 are connected to the bag 52, the folding of the first side element 58 onto the bottom element 56 causes the bag 52 to close. The folding of the first side element 58 onto the bottom element 56 also causes the angle between the two handle elements to approach 180°.

Figure 8:
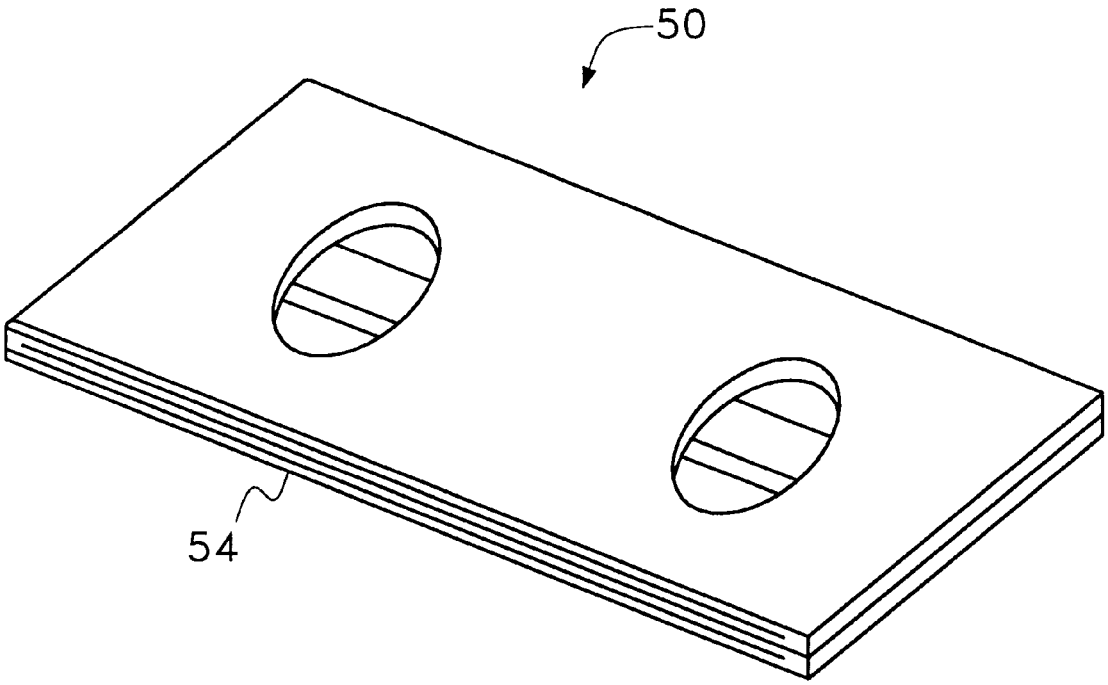
FIG. 8 is a perspective view of the embodiment of FIG. 6 in a folded configuration.

When the two handle elements 70, 72 assume a linear orientation, the handle elements 70, 72 lay against the second side element 60. The abutting second side element 60 and handle elements 70, 72 are then folded over the first side element 58 and the bottom element 56. The overall paperboard frame 54 then is in its flat, folded orientation such as that shown in FIG. 8.

It will be understood that a person skilled in the art can make alternate embodiments of the present invention using functionally equivalent components that have not been specifically described. All such obvious modifications are intended to be included in the scope of this disclosure as defined by the appended claims.

What is claimed is:

1. A scoop device, comprising:

a bag having an open end;

a paperboard frame having a bottom element, a first side element, a second side element and a handle structure, said paperboard frame being selectively configurable between a folded configuration and a deployed configuration, said first side element and said second side element containing fold lines proximate their respective midpoints that enable said first side element and said second side element to collapse toward one another when said handle structure is biased downward and said device is in said deployed configuration, a mechanical locking mechanism that locks said first side element to said second side element when said first side element and said second side element collapse toward one another wherein said bottom element, said first side element and said second side element form a triangular frame with a triangular central opening that holds open said open end of said bag when said paperboard frame is in said deployed configuration, and wherein said bottom element, said first side element and said second side element lay flat atop one another when said paperboard frame is in said folded configuration.

2. The device according to claim 1, wherein said first side element and said second side element converge at an apex point when said paperboard frame is in said deployed configuration and said handle structure extends upwardly from said apex point.

3. The device according to claim 2, wherein said handle structure has at least one hole extending therethrough, wherein said at least one hole is isolated from said triangular central opening when said paperboard frame is in said deployed configuration.

4. The device according to claim 2, wherein said handle structure is comprised of a first handle element and a second handle element that are joined together along a common edge and are folded flat against one another when said paperboard frame is in said deployed configuration.

5. The device according to claim 4, wherein said first handle element is coupled to said first side element and said second handle element is coupled to said second side element.

6. The device according to claim 4, wherein said first handle element is coupled to said second side element and said second handle element is coupled to said first side element.

7. The device according to claim 4, wherein said first handle element and said second handle element lay flat in a common plane when said paperboard frame is in said folded configuration.

8. The device according to claim 4, wherein said bottom element, said first side element, said second side element, said first handle element and said second handle element are interconnected in a continuous loop to form said paperboard frame.

9. The device according to claim 1, wherein said open end of said bag is affixed to said bottom element and only one side element of said paperboard frame.

10. A collapsible scoop device selectively configurable between a folded configuration and a deployed configuration, said scoop device comprising:

a flat bottom element having a first end and a second end;

a flat first side element having a top end and a bottom end, wherein said bottom end of said first side element is coupled to said first end of said bottom element with a flexible connection;

a flat second side element having a top end and a bottom end, wherein said bottom end of said second side element is coupled to said second end of said bottom element with a flexible connection, wherein said first side element and said second side element contain fold lines proximate their respective midpoints that enable said first side element and said second side element to collapse toward one another when in said deployed configuration;

a flat first handle element having a top end and a bottom end, wherein said bottom end of said first handle element is coupled to said top end of said first side element with a flexible connection;

a flat second handle element having a top end and a bottom end, wherein said bottom end of said second handle element is coupled to said top end of said second side element with a flexible connection, and wherein said top end of said second handle element is connected to said top end of said first handle element with a flexible connection;

a mechanical locking mechanism that locks said first side element to said second side element when said first side element and said second side element collapse toward one another.

11. The device according to claim 10, wherein first handle element and said second handle element have a combined length generally equal to said second side element.

12. The device according to claim 10, wherein first side element has a length generally equal to said bottom element.

13. The device according to claim 10, wherein a hole is disposed through said first handle element and said second handle element.

* * * * *